US010311851B1

(12) United States Patent
Stadnyk

(10) Patent No.: US 10,311,851 B1
(45) Date of Patent: Jun. 4, 2019

(54) RECONFIGURABLE ELECTRIC GUITAR PICKUP HOT-SWAP CARTRIDGE SYSTEM

(71) Applicant: Mark A. Stadnyk, Inverness, FL (US)

(72) Inventor: Mark A. Stadnyk, Inverness, FL (US)

( * ) Notice: Subject to any disclaimer, the term of this patent is extended or adjusted under 35 U.S.C. 154(b) by 0 days.

(21) Appl. No.: 16/104,559

(22) Filed: Aug. 17, 2018

Related U.S. Application Data

(63) Continuation-in-part of application No. 15/372,322, filed on Dec. 7, 2016.

(60) Provisional application No. 62/547,838, filed on Aug. 20, 2017.

(51) Int. Cl.
*G10H 1/18* (2006.01)
*G10H 3/18* (2006.01)

(52) U.S. Cl.
CPC ..... *G10H 3/181* (2013.01); *G10H 3/183* (2013.01)

(58) Field of Classification Search
CPC ..... G10H 3/181; G10H 3/183
See application file for complete search history.

(56) References Cited

U.S. PATENT DOCUMENTS 5,252,777 A * 10/1993 Allen ..... G10H 3/182 84/726
5,418,327 A * 5/1995 Lace, Sr. ..... G10H 3/181 84/743
5,767,432 A * 6/1998 Randolph ..... G10D 1/085 84/267
6,043,422 A * 3/2000 Chapman ..... G10H 1/32 84/723
6,800,800 B1 * 10/2004 Giordano ..... G10H 1/32 84/453
7,538,269 B2 * 5/2009 Ekstrom ..... G10D 1/085 84/718
7,838,758 B2 * 11/2010 Van Ekstrom ..... G10H 3/183 84/726
8,283,552 B2 * 10/2012 van Ekstrom ..... G10H 3/183 84/291
9,378,711 B1 * 6/2016 Stadnyk ..... G10D 1/085
9,728,175 B2 * 8/2017 Strassell ..... G10H 3/181
9,847,080 B2 * 12/2017 Chapman ..... G10H 3/183
2018/0204558 A1 * 7/2018 Canivell Grifols .... G10D 1/085

* cited by examiner

*Primary Examiner* — Robert W Horn

(57) ABSTRACT

A cartridge is formed of a mounting plate having a geometric configuration with an upper edge, a lower edge, a left edge, a right edge, an interior surface, and an exterior surface. A higher plate above the mounting plate has a geometric periphery with an upper edge, a lower edge, a left edge, a right edge, an interior surface, and an exterior surface. A plurality of posts couple the interior surface of the mounting plate and the interior surface of the higher plate to create a space for the receipt of at least one pickup. Two spring biased plates are mounted on the mounting plate. A coil spring separates the two spring biased plates. The spring biased plates have locking fingers reciprocally mounted on the mounting plate for engagement with locking projections on a docking ring. Each spring biased plate has a finger hole for retracting the locking fingers.

14 Claims, 8 Drawing Sheets

FIG. 4
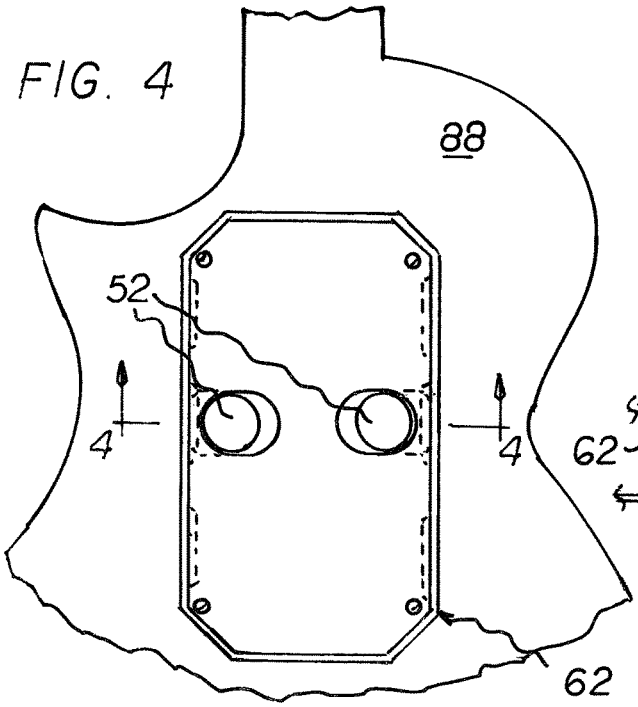
FIG. 5
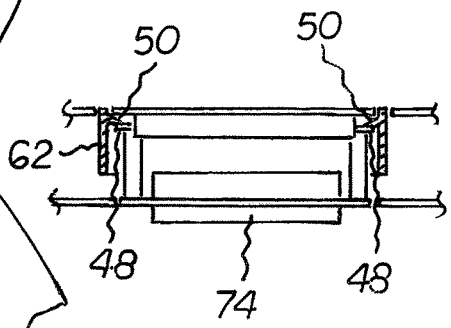
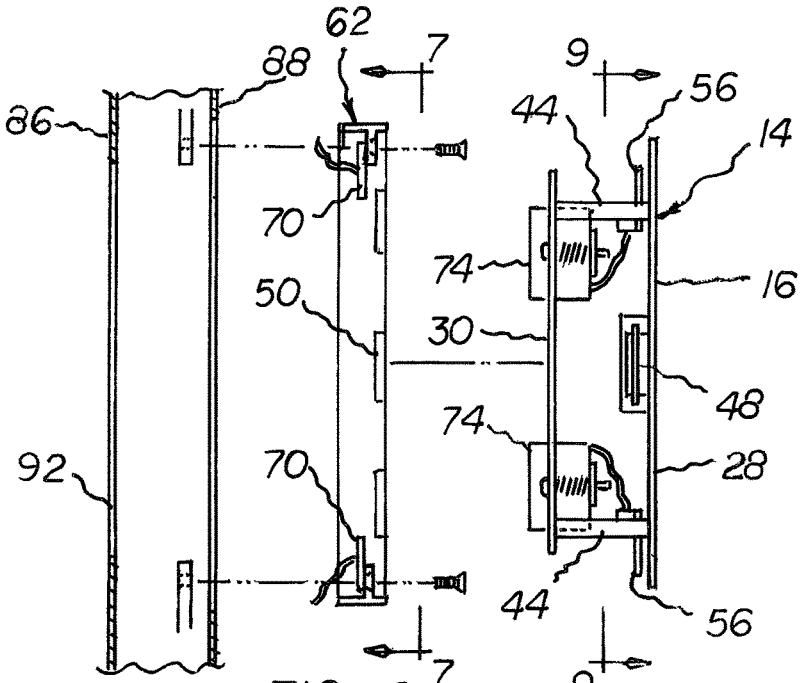
FIG. 6

FIG. 7
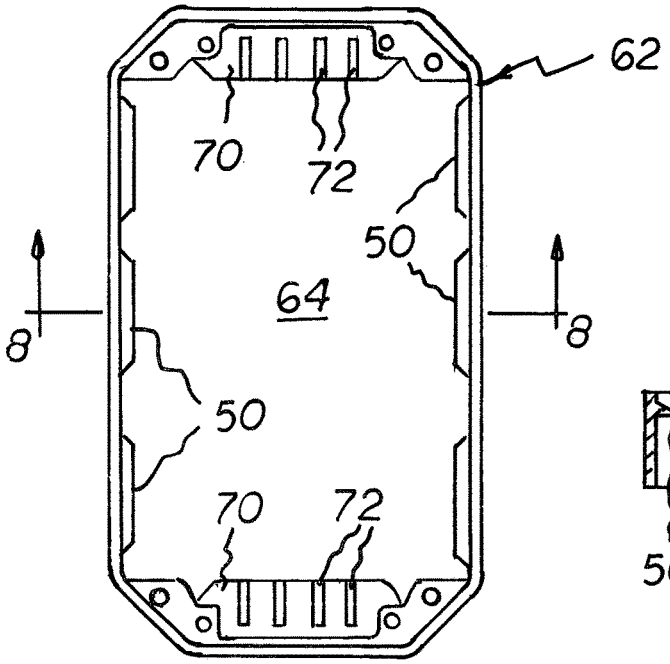
FIG. 8
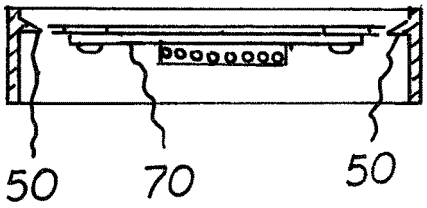
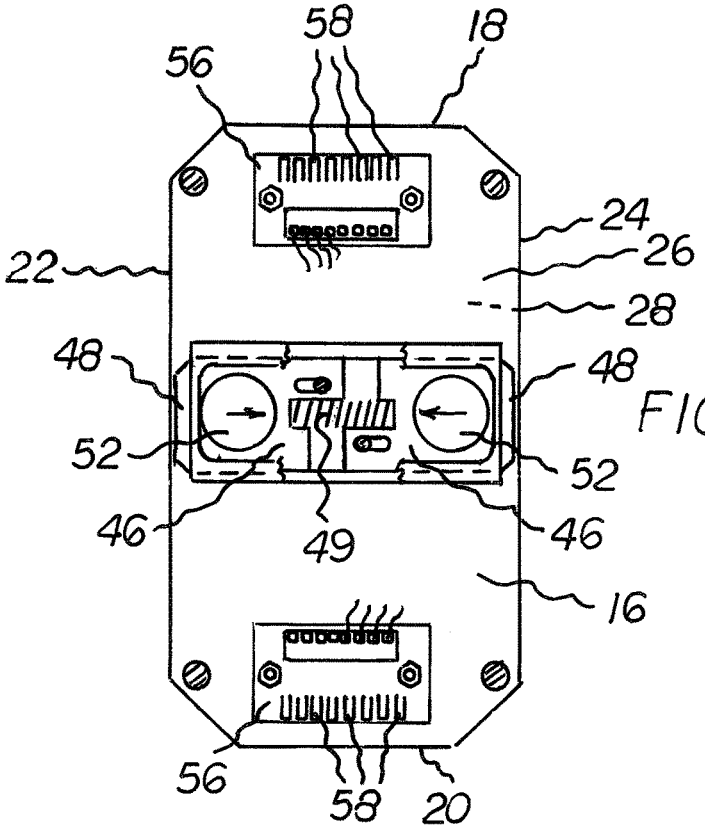
FIG. 9

RECONFIGURABLE ELECTRIC GUITAR PICKUP HOT-SWAP CARTRIDGE SYSTEM

RELATED APPLICATION

The present application is based upon Provisional Application Ser. No. 62/547,838 filed Aug. 20, 2017, and is a continuation-in-part of application Ser. No. 15/372,322 filed Dec. 7, 2017, the subject matter of which applications is incorporated herein by reference and the priority of which is hereby claimed.

BACKGROUND OF THE INVENTION

Field of the Invention

The present invention relates generally to a reconfigurable electric guitar pickup hot-swap cartridge system.

Background of the Invention

Currently there are a number of solutions for the interchangeability of electric guitar pickups from the rear or side of the guitar body. Some of these solutions attempt to provide a means for insertion of removal, but these solutions fail to meet the needs of the industry because the method of insertion or removal is mechanically awkward, limited in capabilities or configuration, or not achievable in one swift simple motion.

Other solutions attempt to provide interchangeability with a cartridge-like system but these solutions are similarly unable to meet the needs of the industry because the cartridge design is not reversible, not multireconfigurable nor is it adaptable to existing guitar body designs where it is desirable to maintain the appearance and integrity of the front surface of the instrument. Still other solutions seek to provide a pickup replacement method but these solutions also fail to meet industry needs because they are not hot-swappable, and/or they do not provide for the adaptation or use of the existing extension spring tremolo systems which are naturally displaced and rendered useless as a result of these other and prior methods.

It would be desirable to have a device that allows electric guitar pickups to be instantly interchangeable and reconfigurable such that the tonal qualities of the instrument may be modified and experimented with at will. Furthermore, it would also be desirable to have a device that requires no tools to accomplish this end, and does not limit the combinations of pickups which can be achieved. Still further, it would be desirable to have a device which can provide such a reconfigurable option without the need to modify the primary, frontal, face or appearance of the instrument. Therefore, there currently exists a need in the industry for a device and associated method that allows for the instant, unlimited and visually favorable method for allowing the pickups in an electric guitar to be interchanged and reconfigured as desired without tools, and without having to unplug the instrument from its amplifier.

SUMMARY OF THE INVENTION

The present invention advantageously fills the aforementioned deficiencies by providing a reconfigurable electric guitar pickup hot-swap cartridge system which provides guitar players with the ability to experiment with the tonal qualities of their instruments easily and almost instantaneously, without tools, without having to dismantle the instrument, and with virtually unlimited combinations and orientations of electro-magnetic pickups.

The present invention is a reconfigurable electric guitar pickup hot-swap cartridge system, which is made up of the following components: the docking ring, the fixed circuit board with fixed electrical-contact fingers, the cartridges with the companion circuit board which mates mechanically and electrically with the contacts of the fixed circuit board, and the pickups. These components are related and connected together as follows: The body of the electric guitar is routed out from the back between the guitar neck and bridge, and the docking ring with fixed circuit boards with fixed electrical-contact fingers are inserted into the cavity. The contact fingers are wired into the controls and output circuits of the electric guitar. The guitar's electromagnetic pickups are screwed into the pickup cartridges, one, two or three pickups per cartridge, and are wired to the cartridge circuit board. The cartridges are then snapped via a mechanical latching system into the docking ring to complete the assembly of the system. With respect to the device it should be further noted that the system is designed so that upon insertion of the pickup cartridge into the docking ring, the cartridge circuit boards align precisely with the fixed electrical-contact fingers to complete an electrical circuit between the pickups and the guitar controls and output circuit, such that the pickups may function as they would should, they have been hard-wired into the electric guitar.

The present invention may also have one or more of the following: The cartridges may be configured in multiple sizes with the ability to hold one, two or three pickups each. The docking ring may be configured with fixed circuit boards with fixed fingers at opposite ends to allow reverse orientation of the cartridges, or along the long sides to allow the same. Furthermore, each cartridge shall have the ability to be rotated and reversed so as to provide for multiple positioning and configurations of one, two or all three pickups. Similarly, the method associated with the present invention may also include one or more of the following steps: Routing of the electric guitar body for the docking ring only part of the way through the back so that the front surface of the instrument remains intact as a continuous surface with only partial holes allowing just the pickups to protrude through, thus preserving the appearance of a conventional electric guitar.

Routing of the guitar body completely through the front surface creating a hole, but allowing multiple pickup configurations and orientations to then be utilized without limitation within the given space.

Manufacture of an acoustic guitar body such that the docking ring is incorporated into the body for future upgrade of the instrument to have this same reconfigurable electric guitar pickup capability.

Manufacture of the pickup cartridges such that one cartridge may hold one or more pickups with related circuitry, whether that cartridge is a full-size (where one cartridge fills the entire docking ring), or partial size where multiple cartridges may occupy the docking ring simultaneously in various combinations and orientations.

Manufacture of the pickup cartridges such that they may position the guitar pickups at different heights and different angles, depending on the overall depth and shape of the instrument.

Manufacture of the pickup cartridges such that the pickup height may be adjusted from the rear of the cartridge.

Manufacture of the cartridges such they may allow the pickups to protrude through existing holes in the front surface of the guitar, or that they incorporate their own front surface as an integral component of the cartridge.

Manufacture of the docking ring such that it may position the pickup cartridges at different heights and different angles, depending on the overall depth and shape of the instrument.

Manufacture of the docking ring incorporating holes, tabs or other method for directly connecting the guitar strings or tremolo system springs to the docking ring.

The present invention is unique when compared with other known devices and solutions because the present invention provides for (1) rapid one-handed electric guitar pickup removal and insertion, (2) hot-swappable pickup removal and insertion, (3) fully reconfigurable pickup combinations allowing virtually unlimited combinations of one, two or three pickups in various configurations and orientations.

The present invention is unique in that it may be manufactured into a production instrument, or retrofitted into an existing electric or acoustic guitar without modifying its front appearance or structure. More specifically, the present invention is unique due to the presence of multiple mechanical latching positions as well as multiple electrical connection positions allowing for virtually unlimited combinations of pickup configurations.

In addition, the present invention is mechanically adaptable not only to electric guitar bodies of varying shapes and angles, but also to acoustic guitar bodies thereby giving them interchangeable pickup capabilities previously unheard of. Also, the present invention provides for the continued use of extension spring tremolo systems by incorporating its own extension spring mounting method which replaces the factory springs that must be removed by necessity during the installation of any such rearmounted guitar pickup system.

Among other things, it is an object of the present invention to provide a reconfigurable electric guitar pickup hot-swap cartridge system that does not suffer from any of the problems or deficiencies associated with prior solutions.

It is still further an object of the present invention to allow for the adaptation of this reconfigurable electric guitar pickup hot-swap cartridge system into existing musical instruments such that the instrument may be upgraded rather than replaced, and without modifying the current outward/frontal appearance.

Further still, it is an object of the present invention to provide a Reconfigurable Electric Guitar Pickup Hot-Swap Cartridge System that does not disable any existing tremolo system without providing a method for the continued functionality of same.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein, rather, these embodiments are provided by way of illustration only and so that this disclosure will be thorough, complete and will fully convey the full scope of the invention to those skilled in the art.

BRIEF DESCRIPTION OF THE DRAWINGS

FIG. 4 is a back elevational view of the cartridge taken along line 4-4 of FIG. 3 showing the locking fingers in the outwardly biased locking position.

FIG. 5 is a cross sectional view taken along line 5-5 of FIG. 2 showing the locking fingers biased against the locking projections.

FIG. 6 is an exploded perspective view of the guitar and docking ring and pickup cartridge of the prior Figures.

FIG. 7 is a back elevational view of the docking ring with the locking projections and circuit boards taken along line 7-7 of FIG. 6.

FIG. 8 is a cross sectional view taken along line 8-8 of FIG. 7 showing two locking projections and a circuit board.

FIG. 9 is a cross sectional view of the outwardly biased locking fingers and portions of the pickups and epositionable circuit board with reposiyionable fingers taken along line 9-9 of FIG. 6.

DETAILED DESCRIPTION OF THE INVENTION

Figure 1:
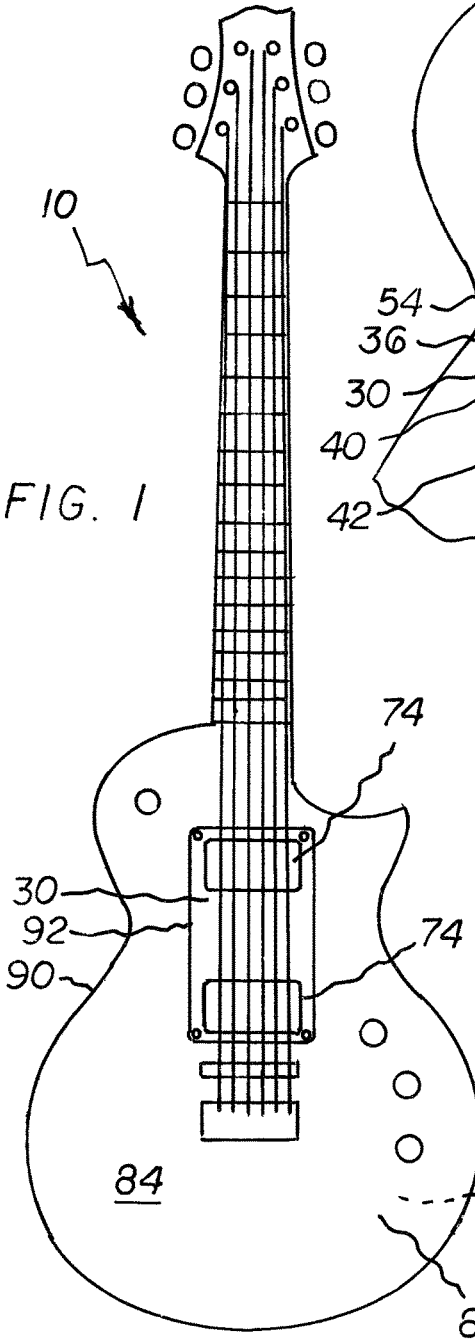
FIG. 1 is a front elevational view of an electric guitar pickup hot swap cartridge system constructed in accordance with the principles of the present invention.
Figure 2:
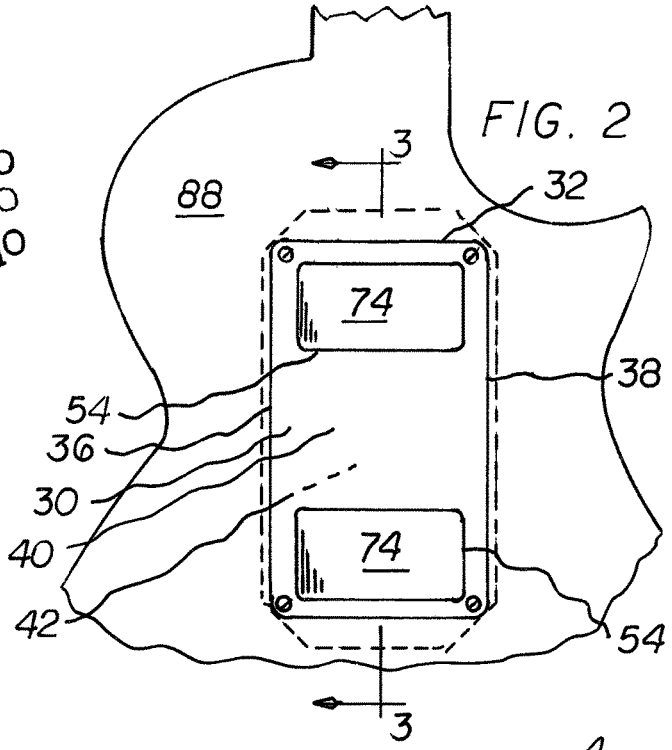
FIG. 2 is an enlarged showing of the two pickups and the faceplate of FIG. 1 but with the strings removed.
Figure 3:
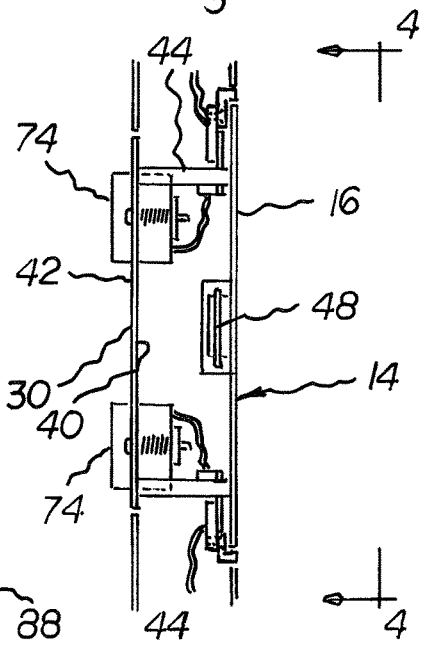
FIG. 3 is a cross sectional view taken along line 3-3 of FIG. 2 with the two pickups extending through the cover plate but, also showing the docking ring circuit boards and a locking finger.
Figure 10:
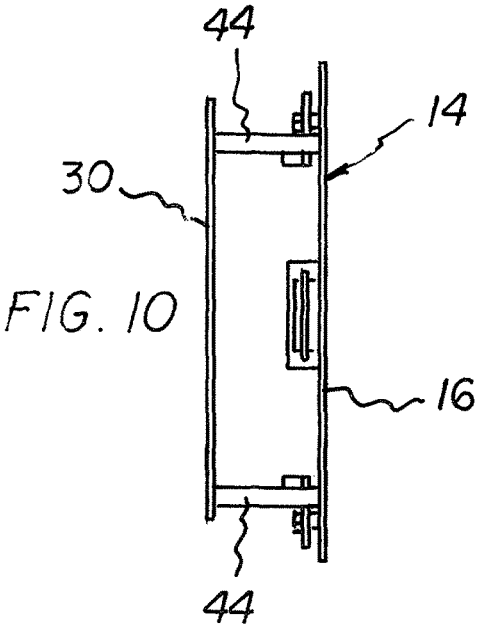
FIG. 10 is a side elevational view of a cartridge with no pickups included.
Figure 11:
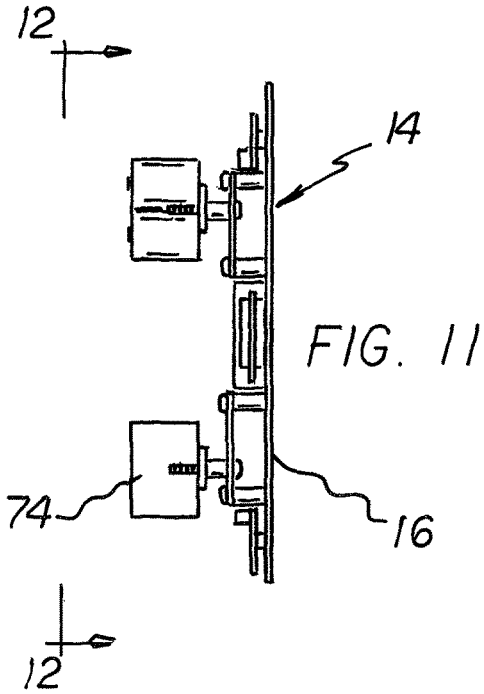
FIG. 11 is a side elevational view of a cartridge with two different types of pickups mounted on a mounting plate but no cover plate.
Figure 12:
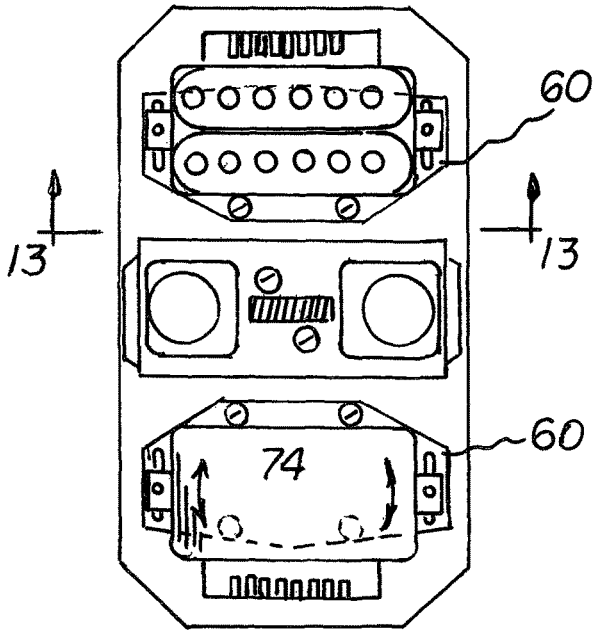
FIG. 12 is a front elevational view taken along line 12-12 of FIG. 11 showing the cartridge with licking fingers and two different pickups mounted for rotational movement.
Figure 13:
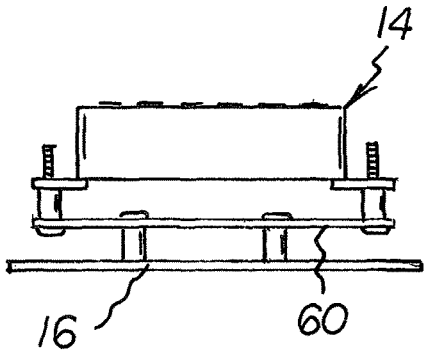
FIG. 13 is a cross sectional view taken along line 13-13 of FIG. 12 showing one pickup and the brackets to facilitate pivoting.
Figure 11A:
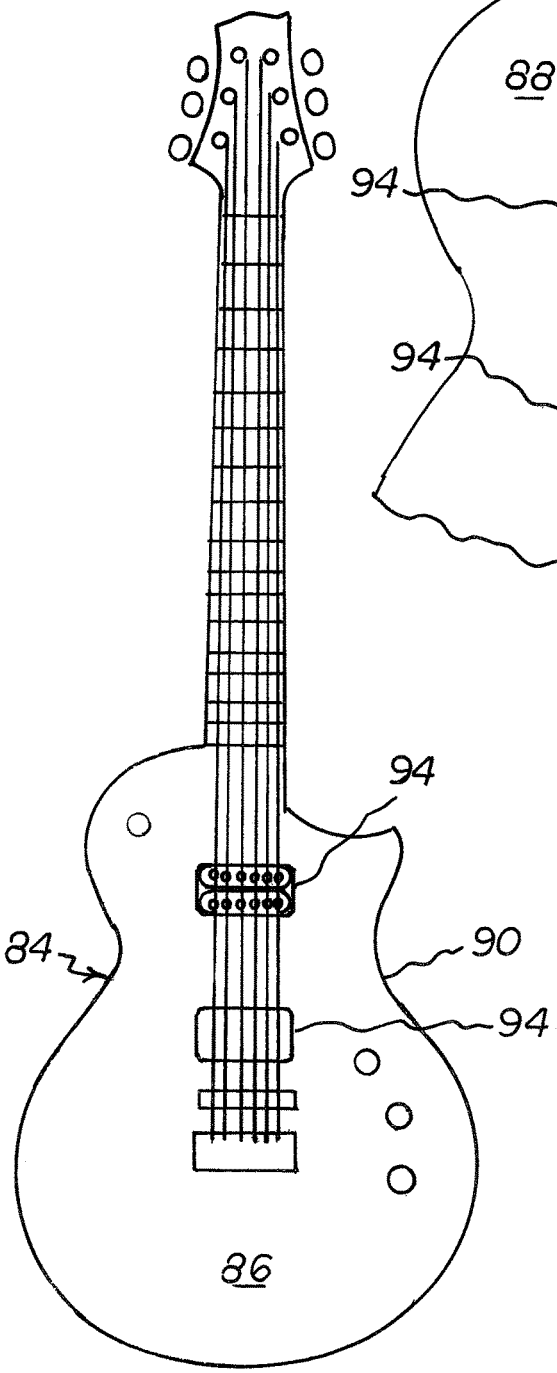
FIG. 11A is a front elevational view of an electric guitar utilizing the pickup cartridge of FIG. 11.
Figure 11B:
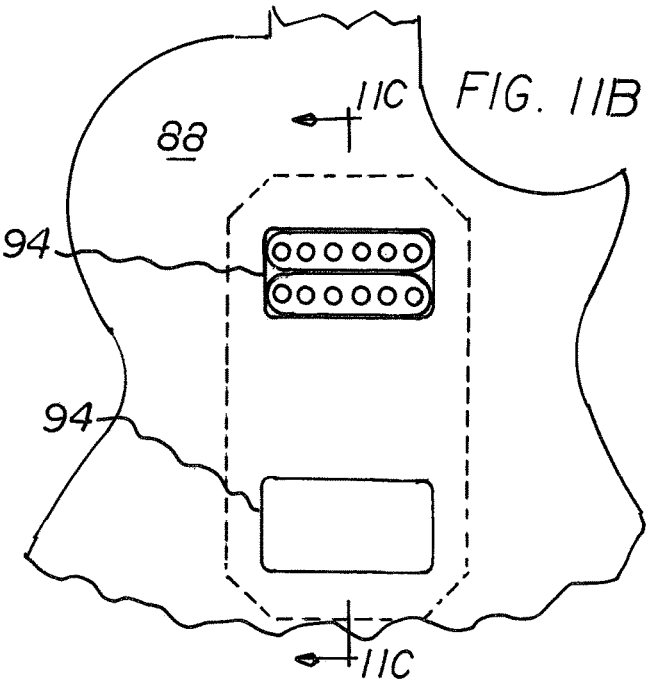
FIG. 11B is an enlarged showing of the pickup and the faceplate of FIG. 11A but with the strings removed.
Figure 11C:
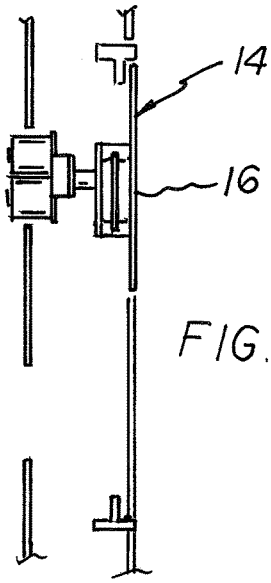
FIG. 11C is a cross sectional view taken along line 11C-11C of FIG. 11B with the pickup extending through the cover plate but also showing the locking finger.
Figure 14:
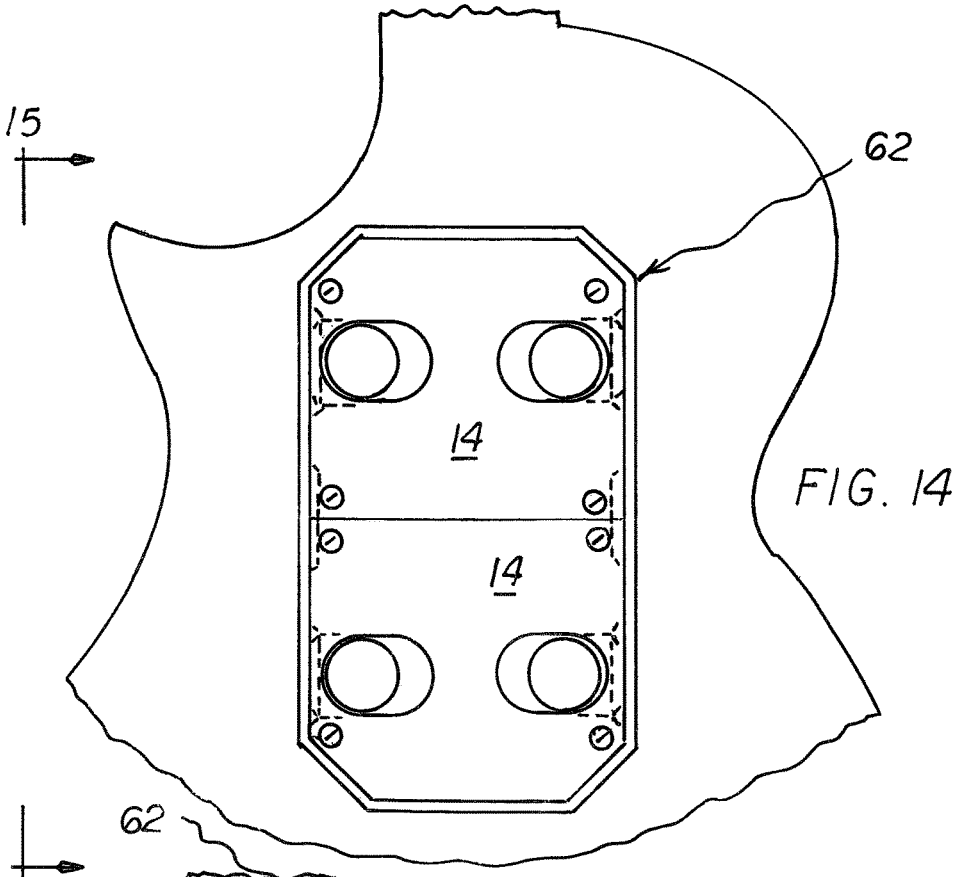
FIG. 14 is a rear elevational view similar to FIG. 4 but with two separate cartridges, each cartridge having a single pickup.
Figure 15:
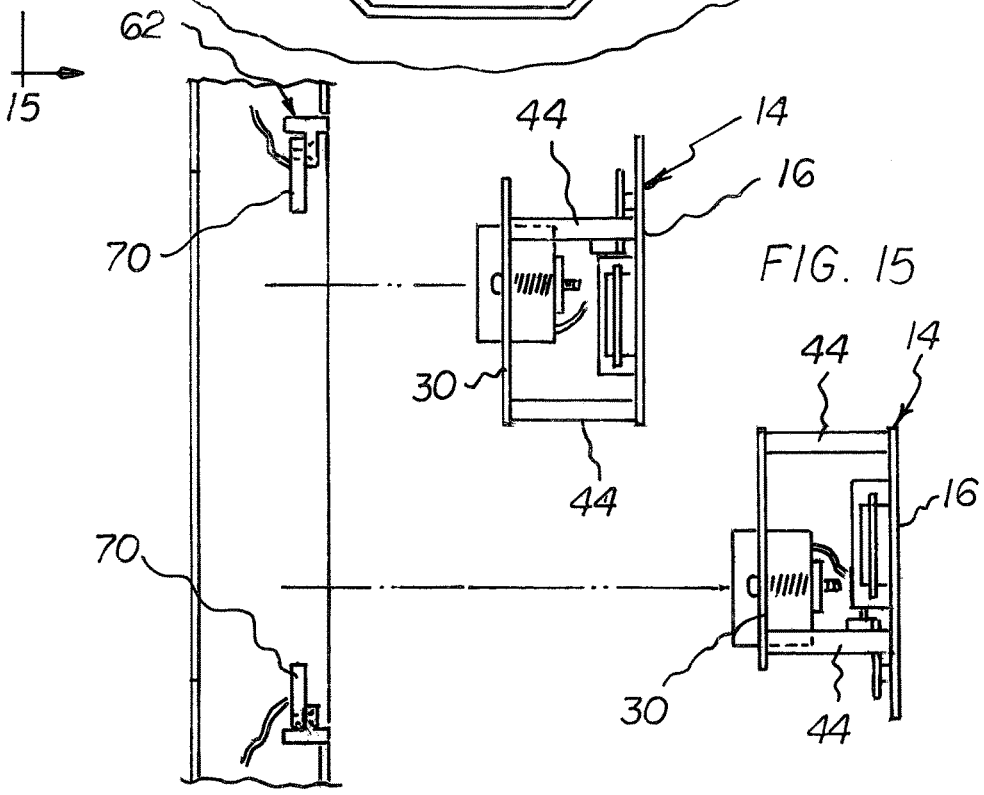
FIG. 15 is an exploded perspective view taken along line 15-15 of FIG. 14 showing the guitar and the docking ring and the two cartridges with two pickups of FIG. 14.
Figure 16:
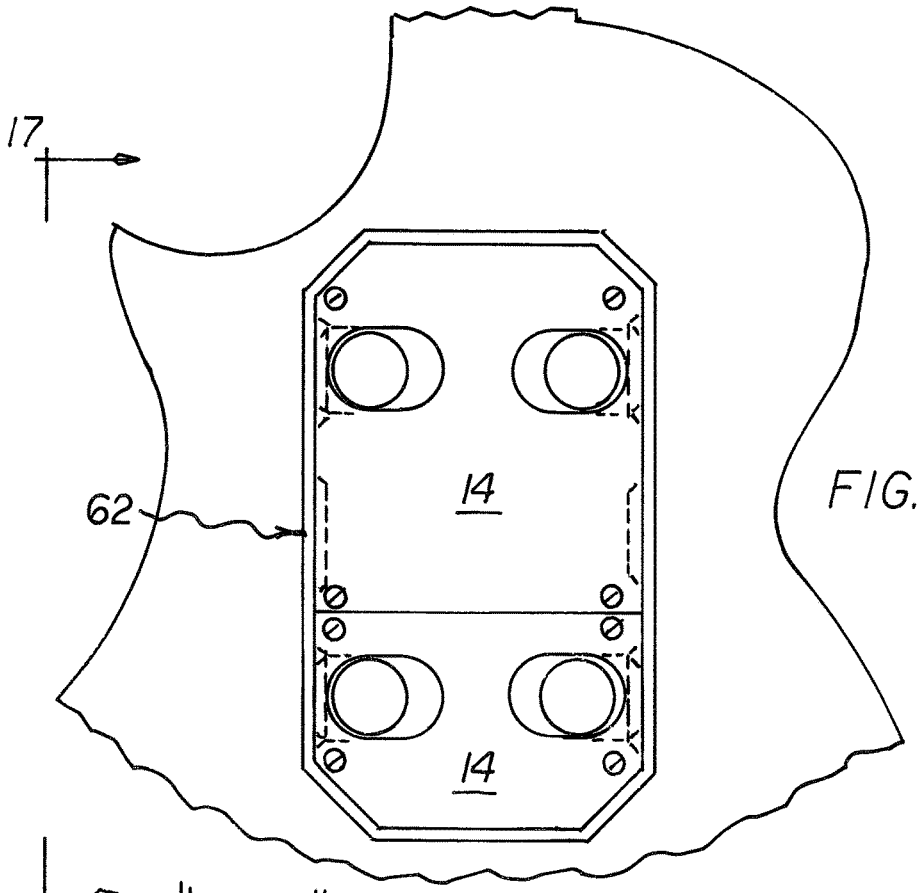
FIG. 16 is a rear elevational view similar to FIG. 44 but with two separate cartridges, one cartridge having two pickup, one cartridge having a single pickup.
Figure 17:
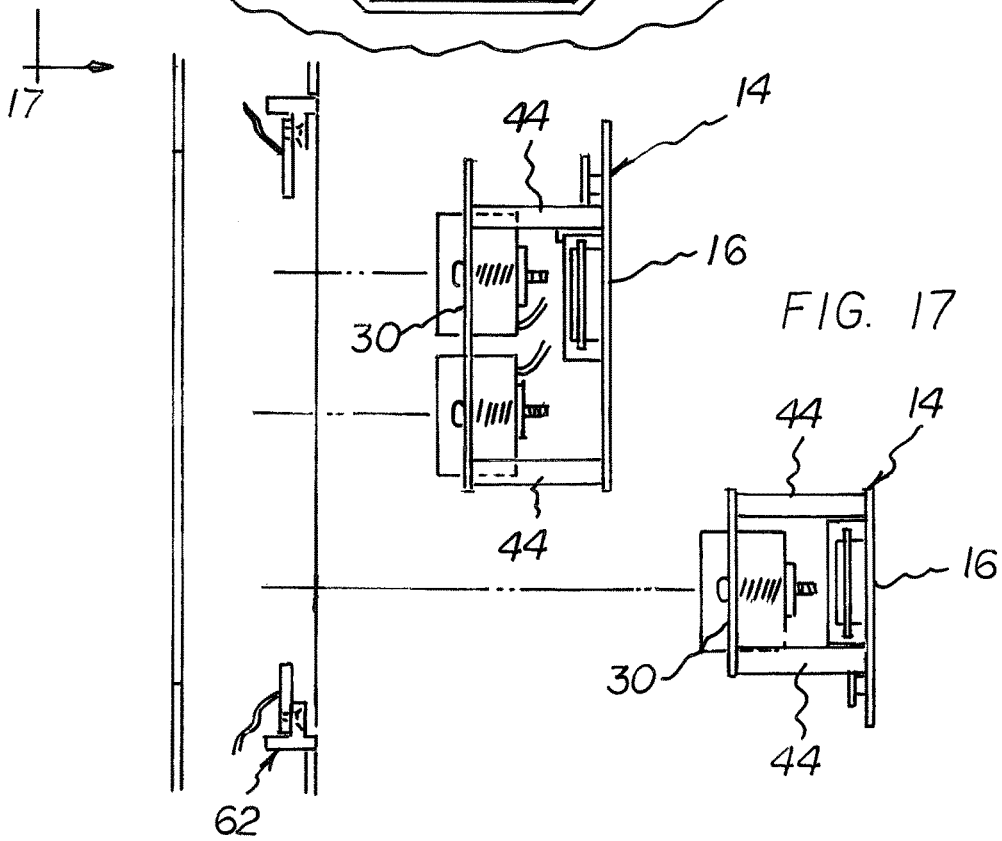
FIG. 17 is an exploded perspective view taken along line 17-17 of FIG. 16 showing the guitar and the two docking rings and the two cartridges with three pickups of FIG. 16.
Figure 18:
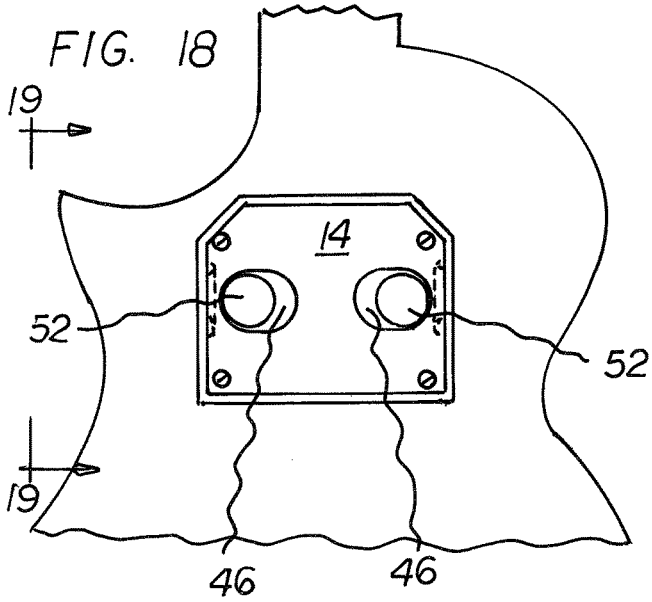
FIG. 18 is a rear elevational view similar to FIG. 4 but with only one cartridge, the one cartridge having a single pickup.
Figure 20:
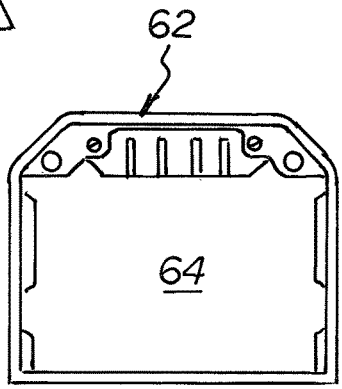
FIG. 20 is a rear elevational view of the docking ring taken along line 20-20 of FIG. 19.
Figure 19:
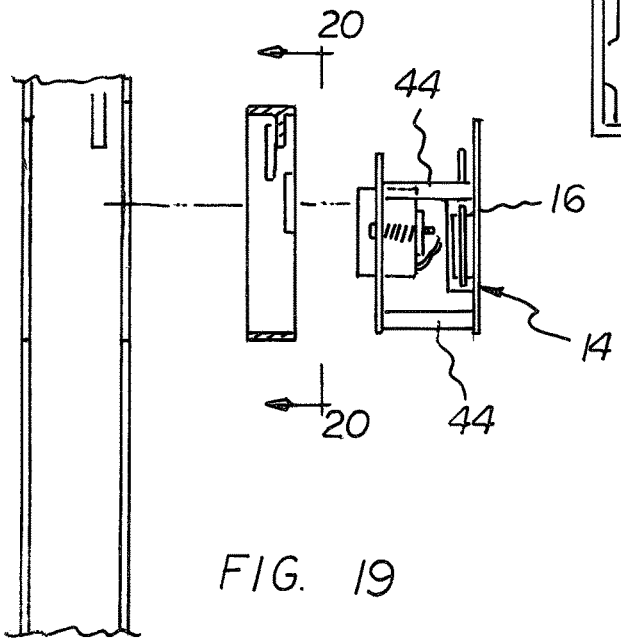
FIG. 19 is an exploded perspective view taken along line 19-19 of FIG. 18 showing the guitar and the docking ring and the cartridges with a single pickup.

The present invention is directed to a reconfigurable electric guitar pickup hotswap cartridge system.

From a broad perspective, the present invention is a reconfigurable electric guitar pickup hot swap cartridge system 10. First provided is a cartridge 14 formed of a mounting plate 16 having a geometric configuration with an upper edge 18, a lower edge 20, a left edge 22, a right edge 24, an interior surface 26, and an exterior surface 28.

By geometric configuration, as used throughout herein, it is meant rectangular, hexagonal, octagonal, or similar configurations.

Next a higher plate 30 is provided above the mounting plate. The higher plate has a geometric periphery with an upper edge 32, a lower edge 34, a left edge 36, a right edge 38, an interior surface 40, and an exterior surface 42.

A plurality of posts 44 are next provided. The posts couple the interior surface of the mounting plate and the interior surface of the higher plate to create a space for the receipt of at least one pickup.

Next, two spring biased plates 46 are mounted on the mounting plate. A coil spring 49 separates the two spring biased plates. The spring biased plates have locking fingers 48. The locking fingers are reciprocally mounted on the mounting plate for engagement with locking projections 50 on a docking ring. Each spring biased plate has a finger hole 52 for retracting the locking fingers.

The system may further include at least one opening 54 in the higher plate for the receipt of at least one pickup.

The system may further include on the mounting plate at least one repositionable circuit board 56 with repositionable fingers 58.

In an alternate embodiment, the higher plate 60 is beneath a pickup, rather than extended above it, serving as a mounting surface for the pickup.

The system may further include a docking ring 62 having a geometric periphery with an open center 64 and a plurality of locking projections 50 coupled to the docking ring extending into the center opening.

The system may further include at least one fixed circuit board 70 with fixed fingers 72. The circuit board is mounted on the mounting plate with connections for the wires of the installed pickup and related circuitry, as well as contacts for connecting to the fixed circuit board contact fingers on the docking ring.

The system may further include at least one pickup 74 supported by the higher plate.

The system may also include an electric guitar 84. The electric guitar has a front 86, a back 88, and a side wall 90 defining a hollow body there between.

In alternate embodiments, the front of the guitar is planar 76 or the front may be non-planar. The front and back of the guitar may also be non-parallel.

In an alternate embodiment, further included is a single opening 92 in the front of the electric guitar for receiving the higher plate and at least one pickup. In another embodiment, included is at least one opening 94 in the front for receiving plural pickups of different styles.

Since the front and rear surfaces of a guitar are not always parallel, the invention includes a modified, or slanted, docking ring. The periphery of the docking ring is on a different plane than the ring mounting surface.

In its most complete form, the present invention device is made up of the following components: the insert docking ring, the fixed circuit boards with fixed electrical-contact fingers, the pickup cartridges, the cartridge circuit board with electrical contacts, and the pickups. These components are related and connected together as follows: The body of the electric guitar is routed out from the back and the docking ring is inserted into the cavity, along with the fixes circuit boards with fixed fingers, one at each end of the docking ring, or several along the sides of the docking ring. The fixed fingers are wired into the controls and output circuits of the electric guitar. The guitar's electro-magnetic pickups are screwed into the pickup cartridges, one, two or three pickups per cartridge, and are wired to the cartridge circuit board. The cartridges consist of the following primary components: a back plate, a latch, a circuit board and a pickup mounting plate. These components are assembled together with an electromagnetic pickup to complete the cartridge. The cartridges are then snapped via the cartridge's mechanical latch into the docking ring to complete the assembly of the system.

With respect to the device it should be further noted that the system is designed so that upon insertion of the cartridge into the docking ring, the fixes circuit board fingers align precisely with the cartridge circuit board contacts to complete an electrical circuit between the pickups and the guitar controls and output circuit, such that the pickups may function as they would should they have been hard-wired into the electric guitar. It should further be noted that this system may be manufactured as part of a production instrument or retrofitted to an existing electric or acoustic guitar body, regardless of the material that the instrument was manufactured from.

The most complete form of performing the method associated with the present invention device consists of the following steps: Routing or constructing the electric or acoustic guitar body to fit the docking ring, whether the routing is partially through or completely through the back of the instrument, with the routing location centrally between the neck and the bridge of the guitar where the electric pickups would normally be. Affixing the docking ring to the guitar body both mechanically and electrically so as to facilitate the connection of the cartridges and their pickups to the guitar controls and output circuit once snapped into the docking ring. It should further be noted that with regard to extension spring tremolo systems which would need their springs removed to make way for this system, the docking ring of this system would provide for an alternate spring mounting system so as to allow a tremolo feature of the guitar to continue to function.

A device and a method associated with the device are described. The device is a reconfigurable electric guitar pickup hot-swap cartridge system which allows a user to remove, insert, and reconfigure the pickups in an electric guitar without tools, without dismantling the instrument, and without unplugging it from its amplifier. This device can be used to exchange the electromagnetic pickups within the electric guitar within seconds, allowing different tones to be achieved.

The core components of the device are: the docking ring, the contact pins circuit boards, the pickup cartridges, the cartridge circuit board, and the pickups. Generally speaking, the configuration of the components is as follows. The body of the electric guitar is routed out from the back between the guitar neck and bridge, and the docking ring is inserted into the cavity, along with the contact pins circuit boards which may be one at each end of the docking ring, or several along the sides of the docking ring. The contact pins circuit boards are wired into the controls and output circuits of the electric guitar. The guitar's electro-magnetic pickups are screwed into the pickup cartridges, one, two or three pickups per cartridge, and are wired to the cartridge circuit board. The cartridges, consisting of a back plate, a latch, a circuit board, and a pickup mounting plate are then snapped, via the cartridge's mechanical latching system, into the docking ring to complete the assembly of the system. It should be noted that the system is designed so that upon insertion of the pickup cartridge into the docking ring, the cartridge circuit board traces align precisely with the docking ring contact pins circuit boards to complete an electrical circuit between the pickups and the guitar controls and output circuit such that the pickups may function as they would if they had been hard-wired into the electric guitar. Furthermore, it should be noted that the pickup cartridges may be configured in multiple sizes with the ability to hold one, two, or three pickups each, each cartridge with the ability to be rotated and reversed so as to provide for multiple positioning and configurations of one, two, or all three pickups.

Following are the core steps to be followed in order to carry out the method. The docking ring shall have multiple latching positions allowing for individual pickup cartridges to be snapped into various positions and orientations. The docking ring shall also have one or more contact pins circuit boards affixed within it to provide for multiple electrical contact positions between the guitar and the pickup cartridges. The pickup cartridges shall be configured with a shape and a latching mechanism which allows them to be connected to the docking ring in multiple positions and orientations while maintaining electrical connection integrity regardless of position or orientation. Ultimately, at the conclusion of these steps, the electric guitar will have the ability to have its pickups removed and/or inserted into the guitar in seconds, and in any orientation or combination as desired by the player, without the need for tools nor disconnection from the guitar amplifier.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A reconfigurable electric guitar pickup hot swap cartridge system (10) comprising, in combination:

a cartridge (14) formed of a mounting plate (16) having a geometric configuration with an upper edge (18) and a lower edge (20) and a left edge (22) and a right edge (24), the mounting plate having an interior surface (26) and an exterior surface (28);

a higher plate (30) above the mounting plate having a geometric periphery with an upper edge (32) and a lower edge (34) and a left edge (36) and a right edge (38), the higher plate having an interior surface (40) and an exterior surface (42);

a plurality of posts (44) coupling the interior surface of the mounting plate and the interior surface of the higher plate to create a space for the receipt of at least one pickup; and two spring biased plates (46) mounted on the mounting plate, a coil spring (49) separating the two spring biased plates, the spring biased plates having locking fingers (48), the locking fingers reciprocally mounted on the mounting plate for engagement with locking projections (50) on a docking ring, the two spring biased plates each having a finger hole (52) for retracting the locking fingers.

2. The system as set forth in claim 1 and further including at least one opening (54) in the higher plate for the receipt of at least one pickup.

3. The system as set forth in claim 1 and further including on the mounting plate at least one repositionable circuit board (56) with repositionable fingers (58).

4. The system as set forth in claim 1 wherein the higher plate (60) is beneath a pickup serving as a mounting surface and providing pivotability for the pickup.

5. The system as set forth in claim 1 and further including:

a docking ring (62) having a geometric periphery with an open center (64), a plurality of locking projections (50) coupled to the docking ring extending into the center opening.

6. The system as set forth in claim 5 wherein the geometric periphery of the docking ring is on a different plane than the ring mounting surface.

7. The system as set forth in claim 1 and further including at least one fixed circuit board (70) with fixed fingers (72).

8. The system as set forth in claim 1 and further including at least one pickup (74) supported by the higher plate.

9. The system as set forth in claim 5 and further including:

an electric guitar (84) having a front (86) and a back (88) and a side wall (90) defining a hollow body there between.

10. The system as set forth in claim 9 wherein the front (86) of the guitar is planar.

11. The system as set forth in claim 9 wherein the front of the guitar is non-planar.

12. The system as set forth in claim 9 wherein the front and back of the guitar are non-parallel.

13. The system as set forth in claim 9 and further including a single opening (92) in the front for receiving the higher plate and at least one pickup.

14. The system as set forth in claim 9 and further including at least one opening (94) in the front for receiving plural pickups of different styles.

* * * * *